US005762736A

United States Patent [19]

Herbert et al.

[11] Patent Number: 5,762,736

[45] Date of Patent: Jun. 9, 1998

[54] FROZEN MATERIAL ASSISTED ELECTROFORM SEPARATION METHOD

[75] Inventors: William G. Herbert, Williamson; Loren E. Hendrix, Webster; Gary J. Maier, Webster; Ernest F. Matyi, Webster, all of N.Y.

[73] Assignee: Xerox Corporation, Stamford, Conn.

[21] Appl. No.: 784,617

[22] Filed: Jan. 21, 1997

[51] Int. Cl.[6] ..... C25D 1/20

[52] U.S. Cl. ..... 156/80; 29/426.5; 205/67; 205/73; 269/7

[58] Field of Search ..... 156/80; 205/67, 205/73, 68–72, 75–79; 269/7; 29/426.5; 264/304

[56] References Cited

U.S. PATENT DOCUMENTS

| | | | |
|---|---|---|---|
| 4,091,580 | 5/1978 | Oates | 269/7 X |
| 4,501,646 | 2/1985 | Herbert . | |
| 4,607,496 | 8/1986 | Nagaura | 269/7 X |
| 4,781,799 | 11/1988 | Herbert, Jr. et al. . | |
| 4,902,386 | 2/1990 | Herbert et al. . | |
| 5,021,109 | 6/1991 | Petropoulos et al. . | |
| 5,064,509 | 11/1991 | Melnyk et al. . | |
| 5,138,918 | 8/1992 | Attardi et al. | 269/7 X |
| 5,357,762 | 10/1994 | Charton | 269/7 X |
| 5,722,320 | 3/1998 | Meyer | 269/7 X |
| 5,723,037 | 3/1998 | Herbert et al. | 205/67 |

*Primary Examiner*—Jeff H. Aftergut
*Attorney, Agent, or Firm*—Zosan S. Soong

[57] ABSTRACT

There is disclosed a method for parting an electroformed article from a mandrel including: (a) solidifying a liquid that is disposed between a parting device and the article, thereby joining the parting device to the article via the solidified liquid; and (b) moving the parting device in a direction of separation of the article from the mandrel while the parting device is joined to the article via the solidified liquid to assist in separation of the article from the mandrel.

10 Claims, No Drawings

FROZEN MATERIAL ASSISTED ELECTROFORM SEPARATION METHOD

BACKGROUND OF THE INVENTION

This invention relates generally to methods for separating an electroform component from a mandrel, and more particularly to methods employing a parting device temporarily joined to the electroform via a solidified liquid. The removed electroformed article may be used for example as a substrate in the fabrication of photoreceptors.

Parting of the electroform from the mandrel typically occurs by hand with the worker gripping the central portion of the electroform during parting. This is disadvantageous since one or more of the following may occur: contamination of the electroform surface such as by dirty or contaminated gloves; marring the finish (matte finish is typically employed to eliminate the plywood phenomenon); scratching or denting the electroform surface; rendering parting more difficult by gripping the electroform which reduces any parting gap between the electroform and the mandrel; and physical damage to the mandrel. There is a need for new separation methods which reduce or eliminate one or more of the above described problems, and this need is met by the present invention.

The following documents may be of interest:

Herbert et al, U.S. Pat. No. 4,902,386, discloses a mandrel having an ellipsoid shaped end;

Herbert, U.S. Pat. No. 4,501,646, discloses an electroforming process which effects a parting gap by heating or cooling;

Petropoulos et al, U.S. Pat. No. 5,021,109, discloses devices and methods to facilitate removal of a tubular sleeve from a mandrel, reference for example, col. 11;

Meinyk et al., U.S. Pat. No. 5,064,509, discloses devices and methods to facilitate removal of an electroformed article from a mandrel, reference, cols. 12–13;

Herbert et al., U.S. Pat. 4,781,799, discloses an elongated electroforming mandrel the mandrel comprising at least a first segment having at least one mating end and a second segment having at least one mating end, the mating end of the first segment being adapted to mate with the mating end of the second segment.

SUMMARY OF THE INVENTION

The present invention is accomplished in embodiments by providing a method for parting an electroformed article from a mandrel comprising:

(a) solidifying a liquid that is disposed between a parting device and the article, thereby joining the parting device to the article via the solidified liquid; and (b) moving the parting device in a direction of separation of the article from the mandrel while the parting device is joined to the article via the solidified liquid to assist in separation of the article from the mandrel.

DETAILED DESCRIPTION

The electroformed article (also referred to herein as the electroform) is temporarily attached to a parting device via the solidified liquid interface which enables the application of the force necessary to separate the electroform from the mandrel.

In one embodiment, a piece of dry ice (i.e., solid carbon dioxide), which is held firmly by the parting device, is brought into contact with the electroform after it exits the cold water soak and has been superficially rinsed with deionized water. The residual deionized water on the outside of and near the end of the electroform freezes before the contaminated (i.e., cold water soak residue) water on the inside of the electroform freezes, thus causing a bond between the electroform and the parting device to form before a bond is formed between the electroform and the mandrel. Force is then applied in a downward direction which causes separation of the electroform from the mandrel. Subsequent rinsing with water (often a desired next step) of the electroform causes the ice to melt, thus causing the parting device to separate from the electroform. Care is taken not to block the preferred hole at the end of the electroform. If one desires to freeze the liquid at the bottom of the electroform, then the air inlet hole can be moved to positions which are higher on the mandrel without a loss of function. One is not limited to using dry ice as any method and apparatus can be employed to obtain the desired freezing temperature at the interface between the parting device and the electroform. To solidify the liquid, the temperature at the interface between the parting device and the electroform may be for example below 0 degrees C., and preferably from about −1 degrees C. to about −5 degrees C. This freezing temperature may be maintained for a period of time ranging for example from about 10 seconds to about 1 minute, and preferably from about 15 seconds to about 30 seconds.

In another embodiment, the liquid is a low melting temperature metal alloy such as Wood's Metal, a binary eutectic (e.g., In 67%/Bi 33%), a ternary eutectic (e.g., Bi 51.6%/Pb 40.2%/Cd 8.2%), or a quinternary eutectic as well as Lipowitz's Metal, Newton's Metal, or D'Arcet's Metal. The metal alloy melts at a temperature ranging for example from about 30 to about 100 degrees C., and preferably from about 40 to about 70 degrees C. In this embodiment, the residual water is allowed to evaporate (evaporation can be speeded by the temperature of the metal alloy), is removed, or is partially removed (e.g., blotting, air blowoff, or wipe) by or before contact is made with the warm/hot metal alloy. After contact is made the metal alloy is allowed to solidify, wherein the solidification is facilitated by the temperature and mass of the electroform and by removing or turning off of the heat.

In embodiments, the parting device remains attached to the electroform via the solidified liquid through the electroform processing steps including for example rinsing, drying, and possibly cutting the electroform to the desired length. The parting device may be for example a mechanical parabolic end parting fixture which operates by grasping the preferably parabolic shaped end of the electroform. The grasping jaws may have as few as three fingers or may completely contact the electroform circumference like a lathe collet. The parting device may have a hole to avoid blocking the mandrel/electroform bleed hole and the parting device may include cooling coils to solidify the liquid at the interface between the parting device and the electroform. The parting device may be fabricated from any suitable materials including for example stainless steel and even rubber.

Preferably during separation of the electroform from the mandrel, the electroform surface is contacted only via the parting device and the solidified liquid. This is to reduce or eliminate one or more of the following: contamination of the electroform surface such as by dirty gloves; marring the finish (matte finish is typically employed to eliminate the plywood phenomenon); scratching or denting the electroform surface; and making parting more difficult by gripping the electroform which reduces any parting gap between the electroform and the mandrel. The present invention by employing the parting device renders more uniform the decrease in the parting gap between the electroform and the mandrel which facilitates separation; previously, a worker, by manually gripping the electroform, would decrease the parting gap to 0 in certain places and would increase the parting gap in others, thereby making separation more difficult. In addition, the present invention in embodiments may reduce the possibility of physical damage to the mandrel since contact with the mandrel surface is minimized. After the electroform is stripped off the mandrel the electroform progresses to the next operational step and the mandrel is cleaned, inspected, and otherwise prepared for reinsertion into the electroform bath where additional electroforms may be made.

In embodiments, an optional effective parting gap may be created between a portion of the electroform and the mandrel to facilitate separation. Preferably, the parting gap ranges from about 0.1 mm to about 1 cm, and more preferably from about 0.1 mm to about 5 mm in width separating the electroform and the mandrel. The parting gap may be created by any suitable method including reliance on differences in the coefficients of thermal expansion between the mandrel and the article. Processes to create a parting gap are illustrated in Bailey et al., U.S. Pat. No. 3,844,906 and Herbert, U.S. Pat. No. 4,501,646, the disclosures of which are totally incorporated by reference.

The mandrel may have any effective design, and may be hollow or solid. The mandrel may have any effective cross-sectional shape such as cylindrical, oval, square, rectangular, or triangular. In embodiments, the mandrel has tapered sides. A preferred mandrel has an ellipsoid or parabolic shaped end, with the mandrel profile preferably like that illustrated in Herbert et al., U.S. Pat. No. 4,902,386, the disclosure of which is totally incorporated by reference. Such a mandrel with an ellipsoid or parabolic shaped end is preferred since the resulting electroform will have a corresponding ellipsoid or parabolic shaped end which provides a gripping surface. Any damage to the ellipsoid or parabolic shaped end of the electroform during parting is generally of no consequence since the end may be discarded, such as by cutting off, in the processing of photoreceptor substrates. The top end of the mandrel may be open or closed, flat or of any other suitable design. The mandrel may be of any suitable dimensions. For example, the mandrel may have a length ranging from about 5 cm to about 100 cm; and an outside diameter ranging from about 5 cm to about 30 cm. The mandrel may be fabricated from any suitable material, preferably a metal such as aluminum, nickel, steel, iron, copper, and the like.

An optional hole or slight depression at the end of the mandrel is desirable to function as a bleeding hole to facilitate more rapid removal of the electroformed article from the mandrel. The bleed hole prevents the deposition of metal at the apex of the tapered end of the mandrel during the electroforming process so that ambient air may enter the space between the mandrel and the electroformed article during removal of the article subsequent to electroforming. The bleed hole should have sufficient depth and circumference to prevent hole blocking deposition of metal during electroforming. For a small diameter mandrel having an outside diameter between about 1/16 inch (0.2 mm) and about 2.5 inches (63.5 mm) a typical dimension for bleed hole depth ranges from about 3 mm to about 14 mm and a typical dimension for circumference ranges from about 5 mm and about 15 mm. Other mandrel diameters such as those greater than about 63.5 mm may also utilize suitable bleed holes having dimensions within and outside these depth and circumference ranges.

The mandrel may be optionally plated with a protective coating. The plated coating is generally continuous except for areas that are masked or to be masked and may be of any suitable material. Typical plated protective coatings for mandrels include chromium, nickel alloys of nickel iron, and the like. The plated metal should preferably be harder than the metal used to form the electroform and is of an effective thickness of for example at least 0.006 mm in thickness, and preferably from about 0.008 to about 0.05 mm in thickness. The outer surface of the plated mandrel preferably is passive, Le., abhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electro-deposited metal such as nickel. However, other suitable metal surfaces could be used for the mandrels. The mandrel may be plated using any suitable electrodeposition process. Processes for plating a mandrel are known and described in the patent literature. For example, a process for applying multiple metal platings to an aluminum mandrel is described in U.S. Pat. Nos. 4,067,782, and 4,902,386, the disclosures of which are totally incorporated by reference.

Articles may be formed on the mandrels of this invention by any suitable known process, preferably electroforming. The electroformed articles may be of any effective thickness, preferably from about 1 mm to about 2 cm, and more preferably from about 2 mm to about 20 mm. The electroforming material and the electroformed articles may be of any suitable metal including nickel, copper, iron, steel, or aluminum.

Processes for electroforming articles on the mandrel are also well known and described, for example, in U.S. Pat. Nos. 4,501,646 and 3,844,906, the disclosures of which are totally incorporated by reference. The electroforming process of this invention may be conducted in any suitable electroforming device. For example, a plated cylindrically shaped mandrel having an ellipsoid shaped end may be suspended vertically in an electrodeposition tank. The electrically conductive mandrel plating material should be compatible with the metal plating solution. For example, the mandrel plating may be chromium. The top edge of the mandrel may be masked off with a suitable non-conductive material, such as wax to prevent deposition. The electrodeposition tank is filled with a plating solution and the temperature of the plating solution is maintained at the desired temperature such as from about 45 to about 65 degrees C. The electrodeposition tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electrodeposition tank may be vertically and horizontally movable to allow the mandrel to be moved into and out of the electrodeposition solution. Electrodeposition current such as from about 25 to about 400 amperes per square foot can be supplied to the electrodeposition tank from a suitable DC source. The positive end of the DC source can be connected to the anode basket and the negative end of the DC source connected to a brush and a brush/split ring arrangement on the drive shaft which supports and drives the mandrel. The electrodeposition current passes from the DC source to the anode basket, to the plating solution, the mandrel, the drive shaft, the split ring, the brush, and back to the DC source. In operation, the mandrel is lowered into the electrodeposition tank and continuously rotated about its vertical axis. As the mandrel rotates, a layer of electroformed metal is deposited on its outer surface. When the layer of deposited metal has reached the desired thickness, the mandrel is removed from the electrodeposition tank.

Any additional suitable method and apparatus may be optionally employed to assist in the removal of the electroformed article from the mandrel For example, vibrational energy, especially ultrasonic energy, is used to cause the electroform to separate from the mandrel. In one embodiment, an ultrasonic bath is used during or after the parting gap is established to assist in removal of the electroform. It is also possible to use a vibrator which contacts the electroform or the mandrel.

Other modifications of the present invention may occur to those skilled in the art based upon a reading of the present disclosure and these modifications are intended to be included within the scope of the present invention.

We claim:

1. A method for parting an electroformed article from a mandrel comprising:

(a) solidifying a liquid that is disposed between a parting device and the article, thereby joining the parting device to the article via the solidified liquid; and (b) moving the parting device in a direction of separation of the article from the mandrel while the parting device is joined to the article via the solidified liquid to assist in separation of the article from the mandrel.

2. The method of claim 1, wherein the liquid is also present between the article and the mandrel and (a) fails to solidify the liquid between the article and the mandrel.

3. The method of claim 1, further comprising (c) liquifying the solidified liquid subsequent to (b).

4. The method of claim 3, wherein (c) comprises heating the solidified liquid.

5. The method of claim 1, wherein the liquid is water.

6. The method of claim 1, wherein the liquid is a metal alloy.

7. The method of claim 1, wherein (a) comprises freezing the liquid.

8. The method of claim 1, wherein (a) comprises subjecting the liquid to a temperature below 0 degrees C.

9. The method of claim 1, wherein the liquid is a metal alloy that is liquified by the application of heat and which is solidified by the absence of the heat, and wherein (a) comprises reducing the level of heat applied to the liquid.

10. The method of claim 1, further comprising placing the article in cold water prior to (a).

* * * * *